US012296244B2

(12) United States Patent
Atwood

(10) Patent No.: US 12,296,244 B2
(45) Date of Patent: May 13, 2025

(54) YOUTH JAVELIN

(71) Applicant: Duncan Fuller Atwood, Kenmore, WA (US)

(72) Inventor: Duncan Fuller Atwood, Kenmore, WA (US)

( * ) Notice: Subject to any disclaimer, the term of this patent is extended or adjusted under 35 U.S.C. 154(b) by 0 days.

(21) Appl. No.: 18/765,123

(22) Filed: Jul. 5, 2024

(65) Prior Publication Data

US 2025/0010157 A1 Jan. 9, 2025

Related U.S. Application Data

(60) Provisional application No. 63/525,423, filed on Jul. 7, 2023.

(51) Int. Cl.
*A63B 65/02* (2006.01)

(52) U.S. Cl.
CPC ..... *A63B 65/02* (2013.01); *A63B 2208/12* (2013.01)

(58) Field of Classification Search
CPC ..... A63B 2208/12
See application file for complete search history.

(56) References Cited

U.S. PATENT DOCUMENTS

| | | | | | |
|---|---|---|---|---|---|
| 2,122,023 | A * | 6/1938 | Campbell | A63B 65/02 | 473/49 |
| 3,337,219 | A * | 8/1967 | Saunders | F42B 6/06 | 473/586 |
| 3,746,334 | A * | 7/1973 | Stubblefield | A63B 65/02 | 473/585 |
| 4,404,053 | A * | 9/1983 | Saffire | B29C 70/08 | 428/377 |
| 5,127,890 | A * | 7/1992 | Noren | A63B 65/02 | 482/20 |
| 5,171,021 | A * | 12/1992 | Orak | A63B 65/00 | 473/607 |
| 5,267,735 | A * | 12/1993 | Bushman | F42B 6/003 | 473/585 |
| D373,611 | S * | 9/1996 | Thompson | D22/118 | |
| 5,951,419 | A * | 9/1999 | Cameneti | F42B 6/06 | 473/586 |
| D435,612 | S * | 12/2000 | Petranoff | D21/707 | |
| 6,585,623 | B1 * | 7/2003 | Hilmer-Gabcke | A63B 65/02 | 482/148 |
| 11,607,592 | B2 * | 3/2023 | Friedman | A63B 65/02 | |
| 2020/0306605 | A1 * | 10/2020 | Friedman | A63B 65/02 | |

* cited by examiner

*Primary Examiner* — Garrett K Atkinson
(74) *Attorney, Agent, or Firm* — Compass Rosa Law; Christopher Villani

(57) ABSTRACT

A youth javelin having a tip, a shaft, a handle and a tail wherein the overall length of the youth javelin is in the range of 135 cm to 148 cm, the weight is in the range of 240 g and 265 g, has a balance point in the range of 57 cm and 60 cm measured from the forward end of the tip, and a weight-to-surface-area ratio in the range of 0.2000 g/cm$^2$ to 0.2585 g/cm$^2$.

8 Claims, 4 Drawing Sheets

(Not to scale)

Section A-A
(Not to scale)

(Not to Scale)

(Not to Scale)

(not to scale)

YOUTH JAVELIN

CROSS-REFERENCE TO RELATED APPLICATIONS

This present application claims the benefit of U.S. Provisional Patent Application Ser. No. 63/525,423 filed on Jul. 7, 2023, which application is incorporated herein by reference in its entirety

GOVERNMENT RIGHTS IN THIS INVENTION

Not applicable.

FIELD OF THE INVENTION

This invention relates to sports throwing implements, specifically a javelin adapted to youth athletes.

BACKGROUND OF THE INVENTION

The javelin, as a sporting implement, has been in use for millennia. In its modern form, javelins are typically manufactured of aluminum, carbon fiber or steel, or a combination thereof, and have specific dimensional criteria, such as weight and center of gravity locations, they must meet to be used in athletic competitions such as the Olympics or interscholastic track and field meets. Men's and women's javelins differ in certain key metrics, with weight being a central distinguishing feature. For reference, men's javelins weigh nominally 800 g, and women's javelins weigh nominally 600 g.

When a dimensionally 'legal' javelin, i.e. a javelin meeting the dimensional criteria set by organizations governing various athletic competitions, is thrown with proper technique, the javelin will follow an optimal flight path. Efficient, optimal javelin flight consists of a climbing phase, a gliding phase, and a turnover to landing phase. Essential to achieving this optimal flight path is making sure the force vector of the throw is lined up with a preferred angle of inclination (i.e. as measured upwards from of the horizontal plane); generally about 35 degrees (in no wind conditions). This alignment of the force vector with the angle of inclination is known in the sport as "throwing through the point." With good alignment, the javelin produces minimum drag and flies farther than with poor alignment in pitch, yaw or sideslip. Javelins shaped for efficient flight will reveal the nature of whatever misalignment they experience—for example, a javelin thrown with the force vector of the throw under the javelin's preferred angle of inclination while the javelin longitudinal axis is released at the preferred angle of inclination will produce a visible stall, creating unwanted drag and reduced distance. Yaw and sideslip misalignments are also easy to see by a trained eye. The aerodynamic drag produced by a misaligned throw also produces a higher load on the athlete's arm, shoulder and torso, depending on how early or late in the throwing action the misalignment occurs. This effect is similar to dragging a hand through water, i.e. a hand held with the palm facing the direction of travel will experience a higher drag load than a hand held with the palm parallel to the direction of travel. Throwing a javelin that reveals the thrower's alignment errors provides important feedback to avoid excessive loads on the athlete and achieve farther throws. Such alignment skill is best learned as soon as possible in an athlete's development. Hence, the need for a youth javelin that mimics the flight characteristics of their senior counterparts.

Typical youth javelins are not optimized to fly like their senior counterparts therefore they do not provide useful feedback for several reasons. Primarily, they have not been proportioned or balanced to fly efficiently when thrown at release speeds typically produced by youth athletes. Secondarily, the materials typically used for youth-scaled javelins are usually the same materials used in the larger models offered by javelin suppliers for reasons of economy and similarities in manufacturing processes. For example, a 300 gram javelin offered by a major producer of javelins is made of aluminum, as are their full-scale javelins, which makes a javelin scaled for youth release speeds too heavy for its surface area to produce an efficient flight. It would be as if an aircraft manufacturer precisely scaled down its jet fighter but installed a very low-powered engine; sub-optimal performance would result. The surface proportions need to change in aircraft when the speeds differ greatly to achieve similar flight performance, as in the case with javelins. World class male javelin throwers produce release speeds of about 28 meters/second, while youth athletes throw at about 13 meters/second. To make a javelin light enough for young athletes to throw, for example in the 200 g to 300 g range, at youth release speeds and follow an optimal flight path like their senior full-scale counterparts, the weight-to-surface-arearatio needs to be optimized.

Accordingly, youth athletes using typically available javelins do not learn optimal and efficient throwing technique and are not rewarded as often with successful throws. Moreover, as youth athletes throw with sub-optimal technique, they are more likely to be prone to injury either due to improper throwing form, or simply throwing too much as they search for an elusive ideal throw. Accordingly, described herein is a youth javelin with an appropriate weight, length, surface to area ration and other dimensional criteria such that when thrown with proper technique the youth javelin will fly at or near an optimal flight path like their full-size counterparts, thus imprinting on youth athletes proper throwing technique they will not have to unlearn as they advance to larger javelins, decreasing the likelihood of injury, and providing a more satisfying path to throwing success.

SUMMARY OF THE INVENTION

The present application provides for a youth javelin optimized for young athletes near or at the beginning of their throwing careers. When thrown at a proper angle of inclination and with sufficient release velocity, the youth javelin will follow an optimal flight path. A preferred youth javelin weight is around 250 g for youth athletes approximately in the 7 to 10 years old age range. A low weight allows for more throwing repetitions before overuse injuries might become an issue. For reference, a Little League baseball weighs approximately 145 g and a football used in Pee Wee football leagues weighs approximately 270 g.

The length of the youth javelin in a preferred embodiment has a length of 138.5 cm, and may be in the range of 135 cm to 148 cm. This length is typically long enough for a youth thrower to see the tip of the youth javelin with their peripheral vision during the course of their throw through run-up and release, which allows the thrower to maintain proper alignment. Additionally, the weight-to-surface-area ratio of the youth javelin is about 0.24 g/cm$^2$. Compare this to the weight-to-surface-area ratio of full-sized javelins of about 0.32 g/cm$^2$. The balance point, i.e. center of gravity, is located approximately 58.5 cm from the tip along the longitudinal axis. Collectively, these dimensional parameters provide a youth javelin meeting the objective of efficient javelin flight along an optimal flight path when released at a proper angle of inclination at a release velocities common to younger throwers.

These and other aspects, features and embodiments are set forth within this application, including the following detailed description and attached drawings. Unless expressly stated otherwise, all embodiments, aspects, features, etc. can be mixed and matched, combined and permuted in any desired manner.

DETAILED DESCRIPTION OF THE PREFERRED EMBODIMENTS

Figure 1A:
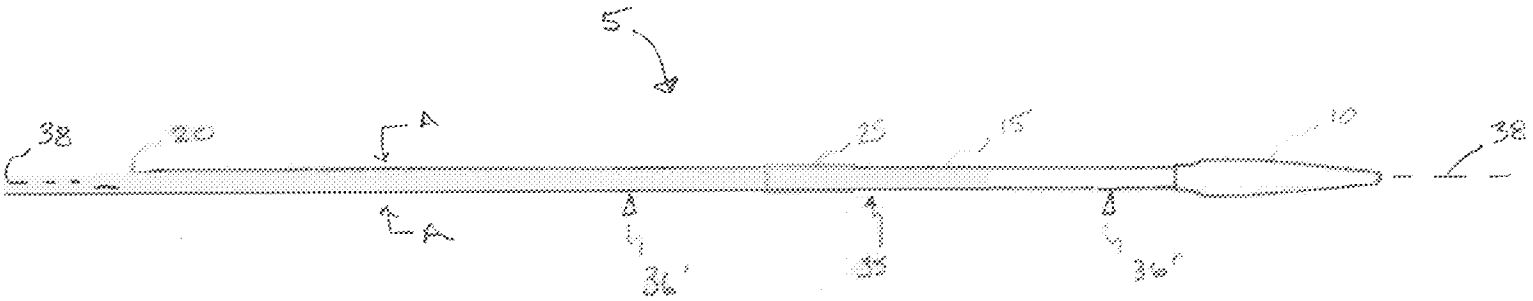
FIG. 1A depicts a side view of an exemplary embodiment of a youth javelin.

A preferred embodiment of the youth javelin 5 is shown in FIG. 1A. The youth javelin 5 has a tip 10, a shaft 15, tail 20, and a handle 25. The balance point, 35, i.e. center of gravity, along the longitudinal axis 38 of the shaft in a preferred embodiment is located 58.8 cm from the forward end of the tip and may be in the range of 57 cm to 60 cm. A grip 25 is positioned along the shaft such that the forward end of the grip, i.e. the end towards the tip, is nominally 60 cm from the tip and may be in the range of 57 cm to 61 cm from the tip. The handle may be molded directly onto the shaft, a separate piece of molded material or similar construction placed on the shaft, or a corded grip wherein a flexible cord-like material is wrapped around the shaft. For avoidance of doubt, throughout this application, the min. and max. values cited in a range of values are included in the range.

The preferred weight of the javelin 5 is 250 g and may be in the range of 240 g and 265 g. A low weight of 250 grams allows a youth athlete more throwing repetitions before overuse injuries become an issue. In Little League baseball, where the implement weight is about 145 g, it is well known that too much throwing can be harmful. The football used in Pee Wee football leagues (age 9) weighs 270 g. By keeping the weight of a preferred embodiment as low as economically feasible, the risk of overuse injuries is reduced, and the flight characteristics are enhanced.

A preferred embodiment has an overall length of 138.5 cm and may be in the range of 135 cm and 148 cm from the forward end of the tip to the end of the tail. The diameter of the youth javelin 5 shaft 15 in a preferred embodiment is nominally 24.7 mm, but may be in the range of 24 mm and 26 mm. In a preferred embodiment, the shaft is engineered to deflect (bend) perpendicular to the longitudinal axis when a component of the force vector imparted by a thrower is not parallel, i.e. "across", to the longitudinal axis. A certain level of deflection or bending of shaft 15 is desirable. In a preferred embodiment, optimal shaft deflection is measured whereby when shaft 15 is supported horizontally 43.5 cm at support points 36' and 36" on either side of balance point 35. When a load of 14 lbs is applied perpendicular to the shaft longitudinal axis 38 at the balance point 35. The preferred deflection is in a range of 15 mm to 30 mm.

Figure 1B:
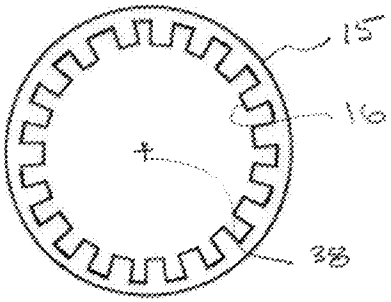
FIG. 1B depicts sectional view A-A of the shaft of a youth javelin.
Figure 2:
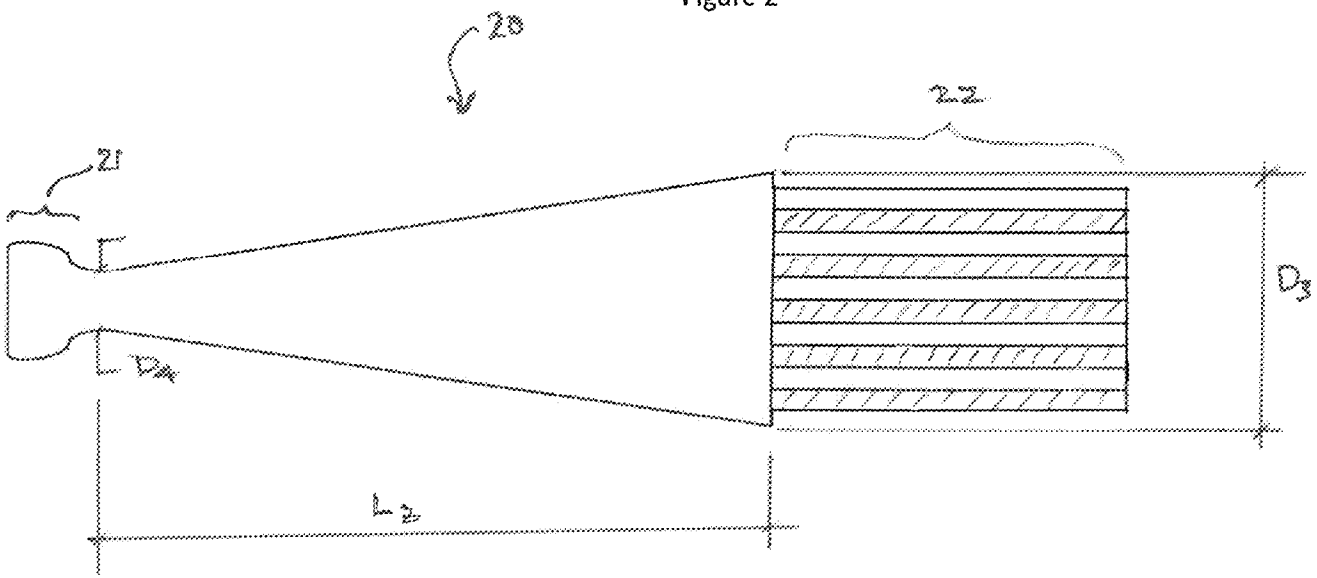
FIG. 2 depicts a side view of an exemplary embodiment of the tail of a youth javelin.

In a preferred embodiment, the shaft 15 is constructed from a molded plastic extrusion having internal longitudinal ridges 16 (Ref. FIG. 1B) parallel to the longitudinal axis 38. These ridges define a female splined portion that may engage with the male splined section 22 of the tail 20 (Ref. FIG. 2.) However, other methods of molding, or fabrication from other materials, such as aluminum, carbon fiber, fiber glass, or wood may be suitable, as long as they meet the shaft deflection requirements. Further, although the internal longitudinal ridge structure may be preferred, the interior surface may be smooth or have other cross sectional shape details.

The weight-to-surface-area ratio, as measured in grams per square centimeter; of a preferred embodiment may have a weight-to-surface-area ratio of substantially 0.24 g/cm$^2$ and may be in the range 0.2000 g/cm$^2$ to 0.2595 g/cm$^2$. The surface area is inclusive of the exterior surfaces of the tip 10, shaft 15, tail 20 and handle 25. When determining the surface area of the handle or grip, surface contours, such as a molded in grip enhancing textures or use of a corded grip can be ignored and the handle surface area presumed to be substantially flat for surface area calculation purposes.

Refer now to FIG. 2. A preferred embodiment of the tail 20 consists of a plastic plug that tapers in substantially a conical shape from a diameter nominally the same as the shaft diameter and varying in the same range as the shaft diameter. The tail tapers over a length $L_2$ of approximately 100 mm to 110 mm before flaring out to an approximately 12 mm diameter by 3 mm thickness safety button 21. The purpose of the safety button element is to prevent accidental impalement. Other shapes may be incorporated in the end of tail 20, such as a substantially hemispherical form to perform the safety function. The tail 20 may have a male splined section 22 that may engages the interior longitudinal ridges 16 of shaft 15. The tail 20 may be affixed into shaft 15 by adhesive, mechanical means, press fit or thermobonding for example. Tail 20 has a maximum diameter, $D_3$, of 24.7 mm and may range from 24 mm to 26 mm, a minimum diameter, $D_4$, in the range of 6 mm to 10 mm at the beginning of the flare into the safety button. The tail length, $L_2$, between the diameters $D_3$ and $D_4$ is in the range of 100 mm to 110 mm.

Figure 3:
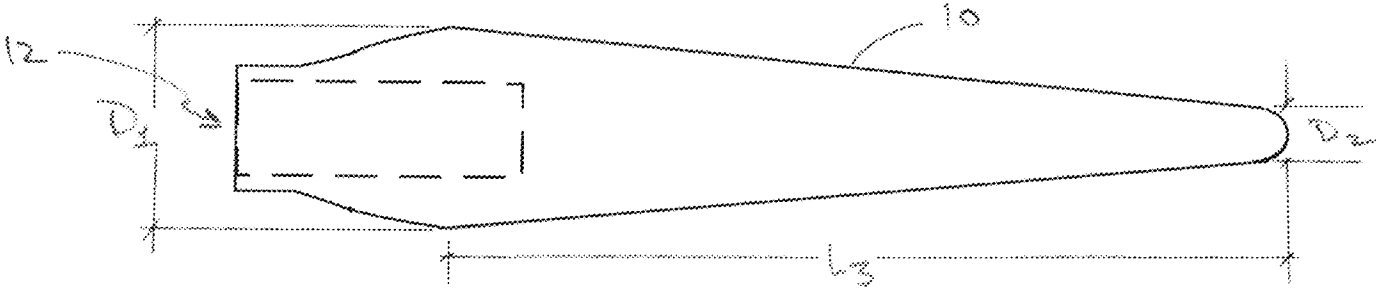
FIG. 3 depicts a side view of an exemplary embodiment of the tip of a youth javelin.

Refer now to FIG. 3 which shows an enlarged view of tip 10. A preferred embodiment of tip 10 may be made of a soft plasticized rubber-like material as another anti-impalement safety feature. The tip material is also resilient enough to resist permanent deformation as a result of repetitive impacts and temporary deformation from aerodynamic forces during flight. Illustrated is a cavity 12 for receiving shaft 15. Tip 10 may be affixed onto shaft 15 by adhesive, mechanical means, press fit or thermobonding for example. In a preferred embodiment, tip 10 has a diameter $D_1$ at its widest point which is 32.5 mm and may range from 28 mm to 35 mm. Further, tip 10 has a diameter $D_2$ at its forward end as the shape transitions into approximately a hemisphere. $D_2$ is 16.75 mm and may range from 15 mm to 20 mm. The length, $L_3$, from $D_1$ to $D_2$ is preferably 137.75 mm and may range from 130 mm to 142 mm.

Figure 4:
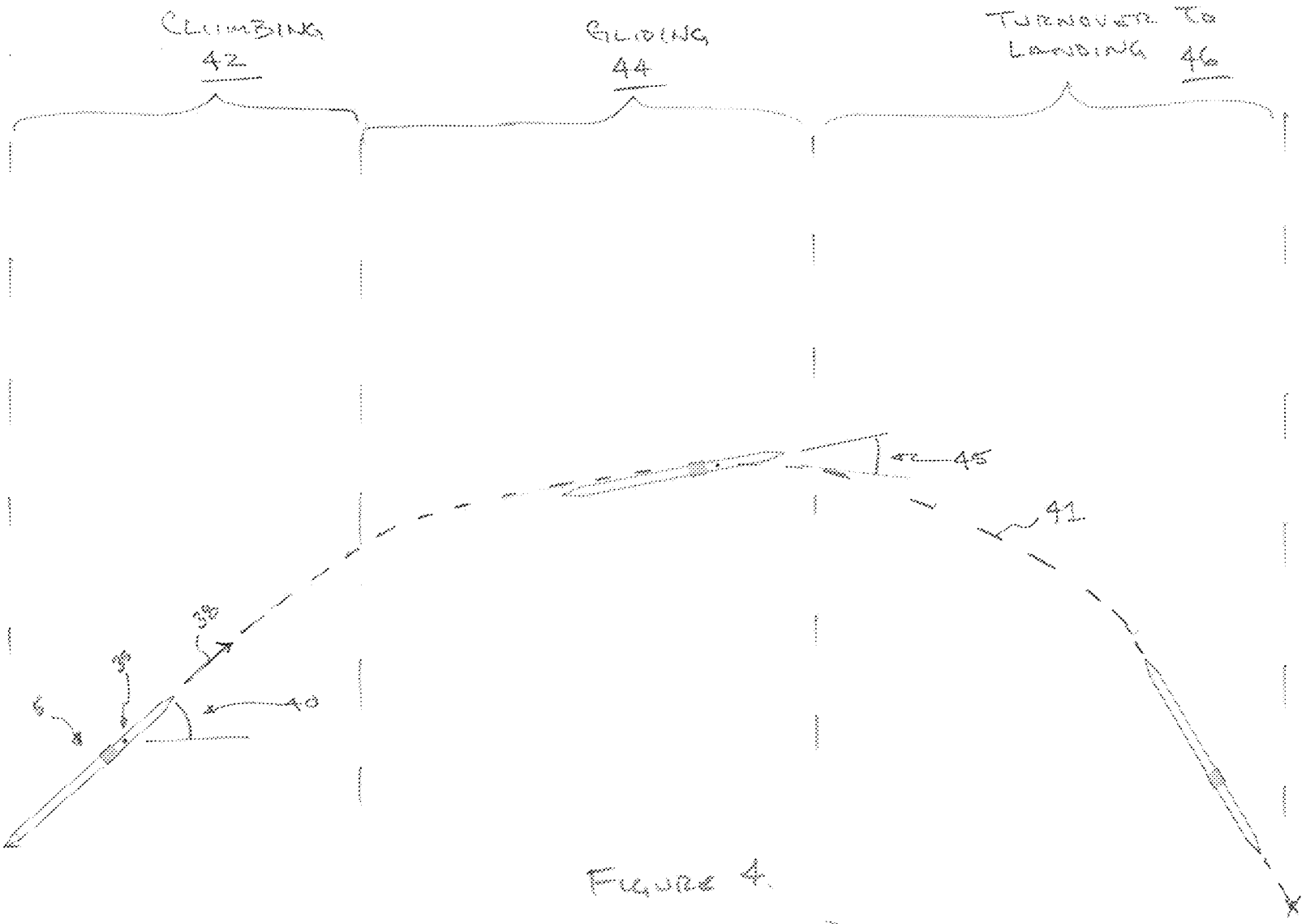
FIG. 4 depicts an optimal flight path for a youth javelin.

Refer now to FIG. 4 which depicts an optimal flight path 41 for a thrown youth javelin 5. When the youth javelin 5 is thrown with a the throwing force vector commensurate with the longitudinal axis 38 (i.e., "thrown through the point") at an initial angle of inclination 40 substantially near 35 degrees, as measured upwards from the horizontal plane, in no wind conditions, and at a release velocity substantially around 13 m/s, the youth javelin 5 enters an initial climbing phase 42 of the optimal flight path. During climbing phase 42, the follows a visually straight trajectory relative to the later phases when the youth javelin 5 starts to slow down. The youth javelin 5 then transitions into gliding phase 44 where the youth javelin 5 settles into a more arcing flight path with a slight nose up angle-of-attack 45 relative to the optimal flight path 41. As more speed has bleeds off the youth javelin 5 enters the turnover and landing phase 46 where it lands tip first. If the youth javelin 5 is thrown such that the balance point 35 is on the proper angle of inclination, but the longitudinal axis 38 is inclined above or below and/or left or right of the vector defined by the flight of the balance point (center of gravity) 35, unwanted additional aerodynamic drag will cause the youth javelin 5 to depart from the optimal flight path.

Selected The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," and "includes" and/or "including" when used in this specification, specify the presence of stated features, integers, steps, operations, elements, and/or components, but do not preclude the presence or addition of one or more other features, integers, steps, operations, elements, components, and/or groups thereof.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

The term "suitable," as used herein, means having characteristics that are sufficient to produce a desired result. Suitability for the intended purpose can be determined by one of ordinary skill in the art using only routine experimentation.

Moreover, terms that are expressed as "means-plus function" in the claims should include any structure that can be utilized to carry out the function of that part of the present invention. In addition, the term "configured" as used herein to describe a component, section or part of a device includes hardware and/or software that is constructed and/or programmed to carry out the desired function. Different aspects of the invention may be combined in any suitable way.

While only selected embodiments have been chosen to illustrate the present invention, it will be apparent to those skilled in the art from this disclosure that various changes and modifications can be made herein without departing from the scope of the present invention as defined in the appended claims. Furthermore, the foregoing description of the embodiments according to the present invention are provided for illustration only, and not for the purpose of limiting the present invention as defined by the appended claims and their equivalents. Thus, the scope of the present invention is not limited to the disclosed embodiments.

What is claimed is:

1. A youth javelin comprising:

a tip, a shaft, a handle and a tail, the youth javelin having a overall length in the range of 135 cm to 148 cm, a weight in the range of 240 g and 265 g, a balance point in the range of 57 cm and 60 cm measured from the forward end of the tip, and a weight-to-surface-area ratio in the range of 0.2000 g/cm$^2$ to 0.2585 g/cm$^2$ wherein when the youth javelin is thrown at an angle of inclination of substantially near 35 degrees and a release velocity substantially near 13 m/s the youth javelin will follow an optimal flight path.

2. The youth javelin of claim 1 wherein the tail includes a safety button.

3. The youth javelin of claim 1 wherein the tip is comprised of a soft plasticized elastic material suitable to protect against impalement but is resilient enough to resist permanent deformation from impacts or deformation in flight due to aerodynamic forces.

4. The youth javelin of claim 1 wherein the shaft has a measurable deflection across the longitudinal axis in a range of 15 mm to 30 mm when the shaft is supported 43.5 cm on either side of the balance point and subjected to a load perpendicular to the longitudinal axis of substantially 14 lbs at the balance point.

5. The youth javelin of claim 1 wherein the tail tapers from a maximum diameter in the range of 24 mm to 26 mm to a minimum diameter in the range of 6 mm to 10 mm over a length of 100 mm to 110 mm between the maximum diameter and the minimum diameter.

6. The youth javelin of claim 1 wherein the shaft is formed from a molded plastic extrusion having internal longitudinal ridges defining a female splined portion.

7. The youth javelin of claim 1 wherein the shaft has a diameter in the range of 24 mm to 26 mm.

8. A youth javelin comprising:

a tip, a shaft, a handle and a tail, the youth javelin having a length in the range of 135 cm to 148 cm, a weight in the range of 240 g and 265 g, a balance point in the range of 57 cm and 60 cm measured from the tip, and a weight-to-surface-area ratio in the range of 0.2000 g/cm$^2$ to 0.2585 g/cm$^2$, the shaft having a diameter in the range of 24 mm to 26 mm and is formed of a molded plastic extrusion having internal longitudinal ridges defining a female splined portion, the tip being formed of a soft plasticized rubber material suitable to protect against impalement but is resilient enough to resist permanent deformation from impacts or deformation in flight due to aerodynamic forces, the tail being formed of a tapered plastic plug with a male splined section to engage the shaft, and the shaft has a measurable deflection across the longitudinal axis in a range of 15 mm to 30 mm when the shaft is supported 43.5 cm on either side of the balance point and subjected to a load of substantially 14 lbs. perpendicular to the longitudinal axis substantially at the balance point.

* * * * *